US006021542A

United States Patent [19]

Norman

[11] Patent Number: 6,021,542

[45] Date of Patent: Feb. 8, 2000

[54] SELF-CLEANING HAIR BRUSH

[76] Inventor: Scott A. Norman, 10109 W. 126th Ter., Overland Park, Kans. 66213

[21] Appl. No.: 09/086,328

[22] Filed: May 28, 1998

[51] Int. Cl.[7] ..... A45D 24/40; A46B 17/06

[52] U.S. Cl. ..... 15/169; 15/160; 15/246; 132/119; 119/628

[58] Field of Search ..... 15/160, 169, 246; 132/119; 119/628

[56] References Cited

U.S. PATENT DOCUMENTS

| | | | |
|---|---|---|---|
| 717,377 | 12/1902 | Flanders | 15/246 |
| 2,529,927 | 11/1950 | Fisk | 15/246 |
| 4,517,703 | 5/1985 | Koke | 15/246 |
| 4,856,541 | 8/1989 | Kellett et al. | 132/110 |
| 5,519,912 | 5/1996 | Kawamura | 15/169 |
| 5,600,865 | 2/1997 | Morrison | 15/169 |
| 5,862,563 | 1/1999 | Hartmann | 15/169 |
| 5,890,255 | 4/1999 | Robinson | 15/169 |
| 5,904,150 | 5/1999 | Caristo et al. | 15/169 |

*Primary Examiner*—Mark Spisich
*Assistant Examiner*—Theresa T. Snider
*Attorney, Agent, or Firm*—Hovey, Williams, Timmons & Collins

[57] ABSTRACT

Improved self-cleaning brushes (10, 44, 64) are provided which include a brush body (12, 46, 66) having a bristle-supporting portion (16, 50, 70) supporting outwardly extending bristles (18, 54, 72). One or more apertured cleaning sheet(s) (36, 56, 76) are mounted on the brushes so as to receive the bristles (18, 54, 72) therethrough. When it is desired to clean the brush (10, 44, 64), the uppermost cleaning sheet (36, 56, 76) is grasped and pulled outwardly and off of the bristles (18, 54, 72), thereby removing hair and other debris from the bristles (18, 54, 72). Preferably, a multiple sheet pad (20, 52, 74) of cleaning sheets (36, 56, 76) are provided, each with perforation lines (38, 57, 80) and grasping tabs (42, 58, 78), to facilitate lift-off removal of the individual cleaning sheets (36, 56, 76).

14 Claims, 2 Drawing Sheets

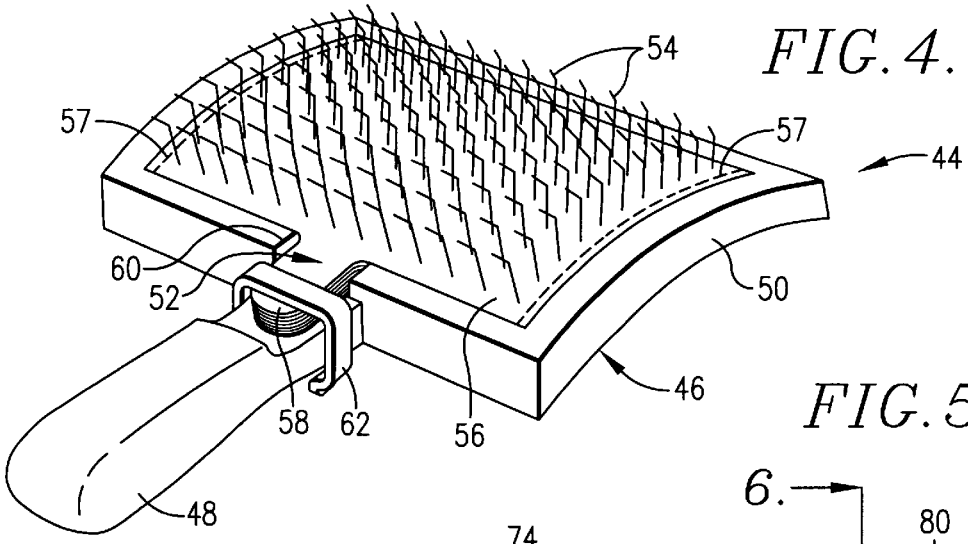
FIG. 4.
FIG. 5.
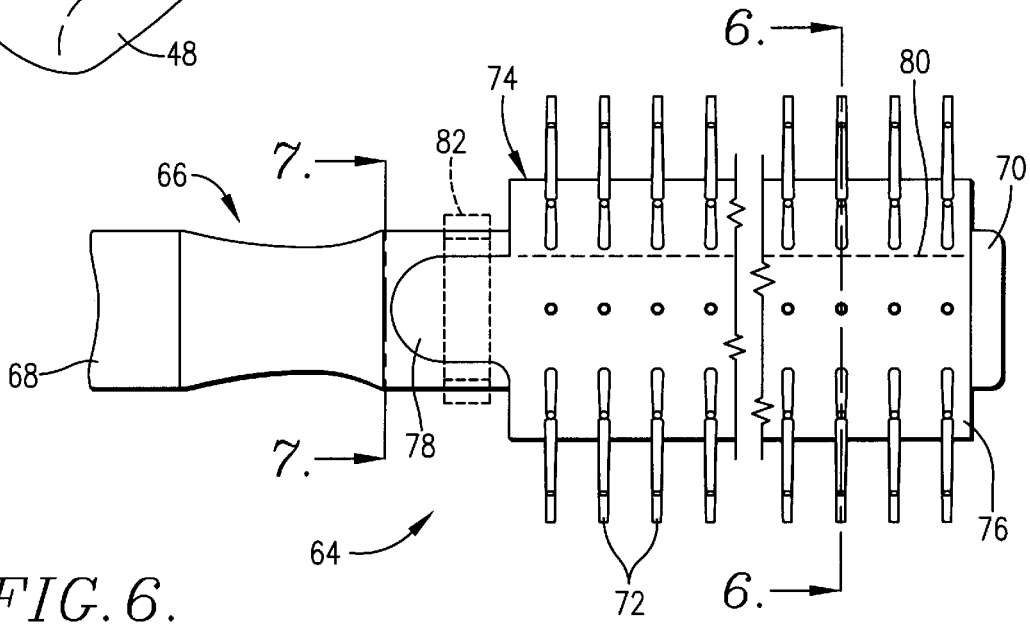
FIG. 6.
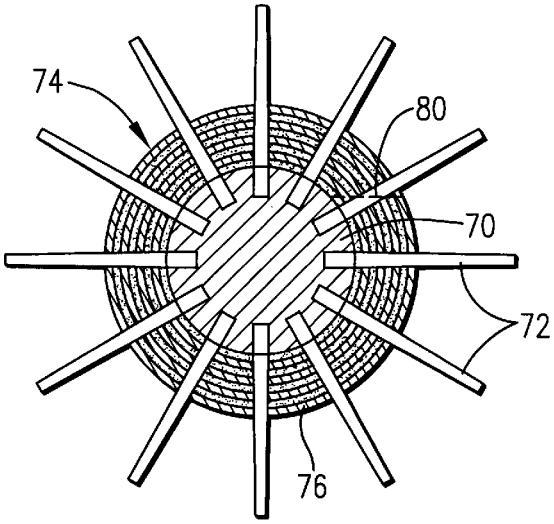
FIG. 7.
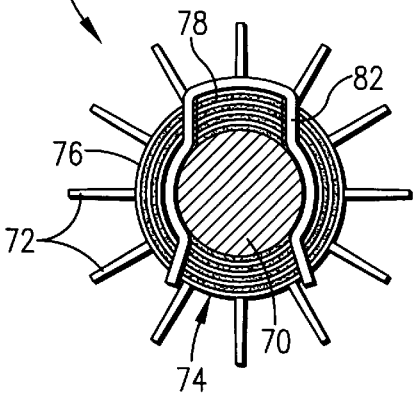

SELF-CLEANING HAIR BRUSH

BACKGROUND OF THE INVENTION

1. Field of the Invention

The present invention is broadly concerned with a self-cleaning brush which allows the user to selectively and effectively clean the brush bristles and other foreign matter which may collect between the bristles. More particularly, the invention is concerned with such a brush and a method of cleaning thereof, wherein the brush is provided with at least one, and preferably a plurality of, apertured cleaning sheet(s) receiving the bristles therethrough and positioned adjacent the brush body; the sheet(s) are mounted for manual lift-off removal thereof from the brush body, thereby removing hair and other foreign materials from the bristles.

2. Description of the Prior Art

Brushes of various types such as hair brushes, lint brushes and pet brushes suffer from the problem of cleaning hair and other foreign materials from the brush bristles. That is, through continued use such brushes become fouled with hair, lint and dirt, and must be periodically cleaned. Generally, brushes are cleaned by placing them in water and/or by application of a comb or other brush through the bristles to remove foreign materials. As brush users will attest, such expedients often are not fully effective.

There is accordingly a need in the art for an improved brush design which can be readily cleaned by the user without the need for time-consuming and difficult cleaning procedures.

SUMMARY OF THE INVENTION

The present invention overcomes the problems outlined above and provides a self-cleaning brush including an elongated body having a handle portion and a bristle-supporting portion, with a plurality of spaced apart bristles operatively coupled with the bristle-supporting portion and extending outwardly therefrom. An apertured cleaning sheet is also provided which receives bristles therethrough and is positioned proximal to the bristle-supporting portion of the body; the cleaning sheet is mounted for manual lift-off removal thereof from the bristle-supporting portion for thereby removing hair or other foreign materials from the bristles.

In alternate forms of the invention, a single cleaning sheet may be provided, secured to the brush body by any convenient means such as hook and loop Velcro material. More preferably, a pad of cleaning sheets is provided with each sheet being oriented in face-to-face relationship. From time to time as brush cleaning is required, the user need only strip the uppermost cleaning sheet from the pad thereof, thereby removing foreign material from the bristles. In this form of the invention, the individual lift-off cleaning sheets preferably have adhesive applied to the undersides thereof. Additionally, each of the sheets preferably has a tab portion extending away from the bristles for facilitating manual grasping of each sheet individual for lift-off removal thereof.

Brushes in accordance with the invention can be virtually any design or style. That is, otherwise conventional hair brushes can be equipped with the cleaning sheets of the invention, as can wire bristle pet brushes or cylindrical brushes.

BRIEF DESCRIPTION OF THE DRAWINGS

FIG. 4 is a perspective view of another embodiment of the invention, i.e., a wire bristle pet brush having the cleaning improvement of the invention;

FIG. 5 is a fragmentary side view of another style of brush, namely a cylindrical hair brush, equipped with an annular pad of individually removable cleaning sheets;

FIG. 6 is a vertical sectional view taken along line 6—6 of FIG. 5 and illustrating the construction of the cylindrical brush and annular pad of cleaning sheets; and FIG. 7 is a sectional view taken along line 7—7 of FIG. 5 and illustrating the removable clip forming a part of the preferred cleaning pad designs.

DETAILED DESCRIPTION OF THE PREFERRED EMBODIMENT

Figure 1:
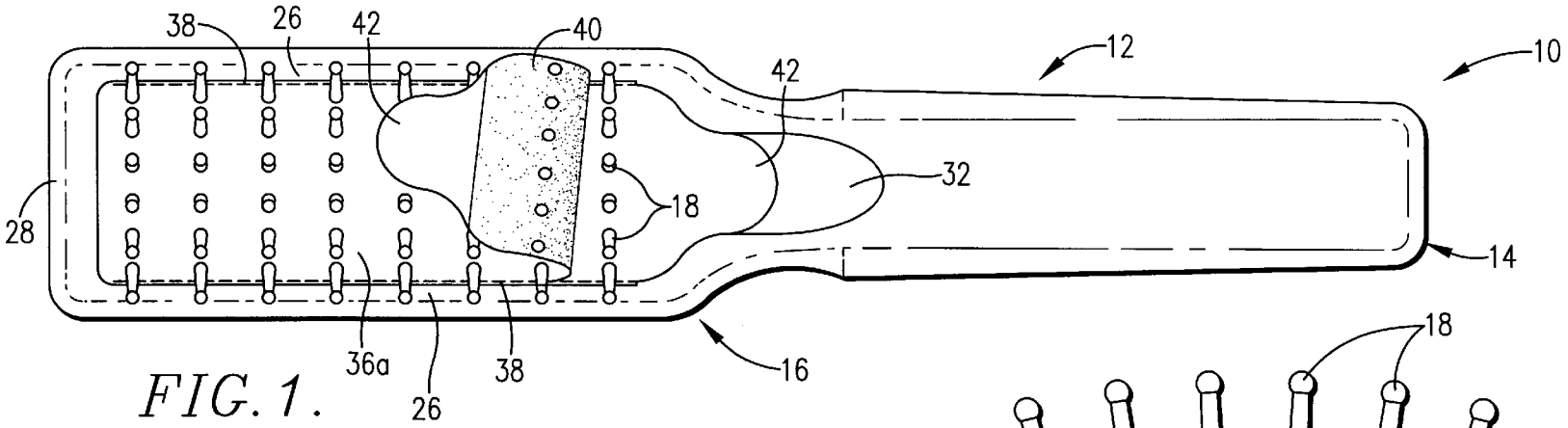
FIG. 1 is a plan view of a hair brush in accordance with the invention, equipped with a pad of cleaning sheets in accordance with the invention, and illustrating removal of the topmost cleaning sheet from the pad.
Figure 3:
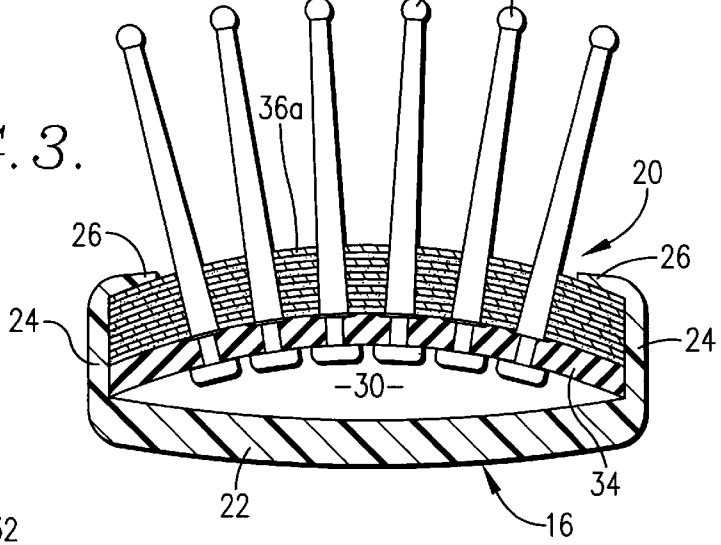
FIG. 3 is a vertical sectional view taken along line 3—3 of FIG. 2 and further illustrating the construction of the improved brush of the invention.
Figure 2:
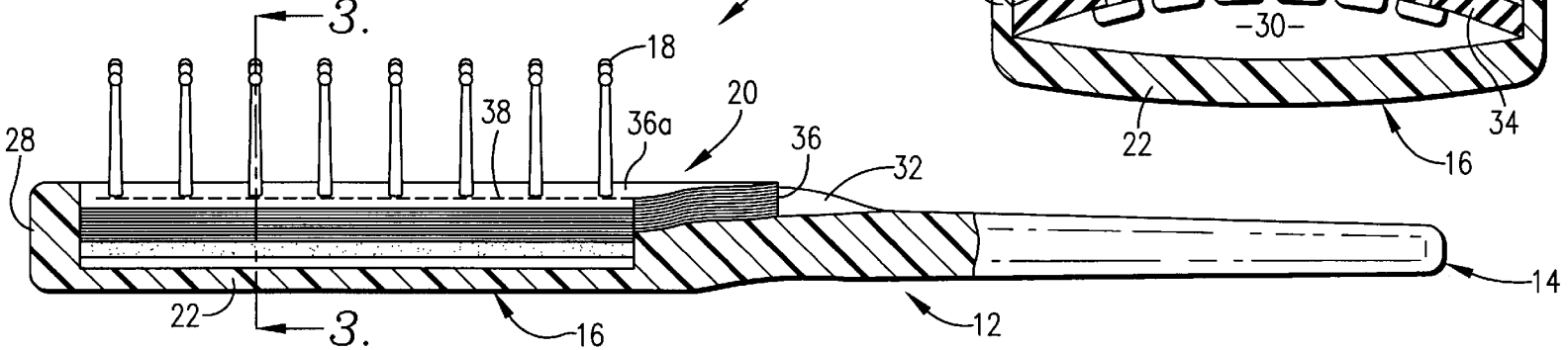
FIG. 2 is a partial vertical sectional view of the brush illustrated in FIG. 1, and depicting the design and orientation of the multiple cleaning sheet pad.

Turning now to the drawings and particularly FIGS. 1–3, a hair brush 10 is illustrated which broadly includes a brush body 12 having an elongated handle portion 14 as well as a bristle-supporting portion 16. The portion 16 supports a plurality of spaced apart bristles 18, as well as a pad 20 of apertured cleaning sheets.

In more detail, it will be observed that the body 12 is an integral member formed of any desired material such as a rigid synthetic resin. The handle portion 14 is of convenient length to be readily grasped by the user. The portion 16 includes a gently arcuate bottom wall 22, a pair of side marginal, upstanding sidewalls 24 each terminating in an inwardly extending flange 26 (FIG. 3) and a front wall 28. The sidewalls 24 and front wall 28 cooperatively define a hollow region 30. It will further be observed that the bottom wall 22 is provided with an arcuate depression 32 in the upper face thereof (FIG. 1) which leads to and communicates with the region 30.

A resilient synthetic resin foam pad 34 is situated within the region 30 and has the side marginal edges thereof in engagement with the inner surfaces of the sidewalls 24, so that the pad 34 assumes an arcuate configuration in cross-section. As illustrated in FIG. 3, the pad 34 has the bristles 18 secured thereto in the conventional manner, so that the bristles 18 extend upwardly from the pad.

The cleaning sheet pad 20 is made up of a plurality of individual sheets 36 which are in face-to-face relationship with an uppermost sheet 36*a*. As shown, each of the sheets 36 has a series of registered apertures, with the bristles 18 extending upwardly through the sheets. It will also be observed that the pad 20 is captively retained by the inturned flanges 26 extending along the lengths thereof. In order to facilitate sheet-by-sheet removal of the cleaning sheets, the respective sheets each have a pair of side marginal perforation lines 38 formed therein which extend along the length of each sheet just inboard of the adjacent flange 26. In preferred forms, the undersides of each of the sheets 36 has a conventional adhesive 40 applied thereto so that the sheets will remain in place until used. Finally, each of the sheets preferably has a tab extension 42 extending away from the bristles 18 and into the depression 32.

When it is desired to clean the brush 10, the user need only grasp the topmost cleaning sheet 36*a* at the tab 42 thereof, followed by peeling of this sheet along the length of the brush portion 16. As shown in FIG. 1, this is readily accomplished owing to the presence of the side marginal perforation lines 38. It will also be understood that as the topmost sheet 36*a* is removed, hair and other debris between the bristles 18 is likewise removed, thereby leaving a clean brush for continued use.

The principles of the invention can be incorporated into a wide variety of brush designs. For example, FIG. 4 illustrates a wire bristle brush 44 having an integral brush body 46 presenting a handle portion 48 and an arcuate bristle-supporting portion 50. As in the case of brush 10, the brush 44 is equipped with an apertured, multiple sheet cleaning pad 52 positioned with the wire bristles 54 extending therethrough. Each of the cleaning sheets 56 of the pad 52 has an integral tab section 58 which extends through an appropriate recess 60 in the brush portion 50; additionally, the side margins of the sheets 56 have perforation lines 57. A shiftable retainer clip 62 is mounted on the handle 48 as shown, and overlies the tabs 58 of the cleaning sheets 56. In the cleaning of brush 44, the clip 62 is shifted so as to expose the topmost tab 58, whereupon the user simply strips the uppermost cleaning sheet from the pad 52 along perforation lines 57.

FIGS. 5–7 depict another type of brush 64, in this instance a cylindrical hair brush. The brush 64 has a main body 66 presenting a handle 68 as well as a cylindrical bristle-supporting portion 70. A series of spaced bristles 72 are secured to the portion 70 and extend radially outwardly therefrom. An annular, apertured, multiple sheet cleaning pad 74 is positioned about the brush portion 70 as best illustrated in FIG. 6. The pad 74 has a plurality of individual, annular cleaning sheets 76, with each such sheet including a projecting tab 78 and an elongated perforation line 80. As in the case of the previous embodiments, the annular sheets 76 have registered openings so as to receive the bristles 72. A removable clip 82 is positioned over the tabs 78 so as to maintain these during normal use of the brush. During cleaning operations, the clip 82 is removed and the topmost tab 78 is grasped and lifted so as to separate the outermost cleaning sheet 76 along the perforation line 80. This allows the user to fully remove the cleaning sheet from the bristles, thereby simultaneously removing all foreign material between such bristles. After the cleaning operation, the clip 82 is then replaced.

It will thus be seen that the brushes of the present invention allow the user to readily and effectively clean the brush bristles, all without the troublesome cleaning steps characteristic of conventional brushes.

I claim:

1. A self-cleaning brush comprising:

an elongated body including a handle portion and a bristle-supporting portion;

a plurality of spaced-apart bristles operatively coupled with said bristle-supporting portion and extending outwardly therefrom;

a resilient pad comprising a plurality of individual, adjacent, apertured, face-to-face oriented, flexible cleaning sheets receiving said bristles therethrough and positioned on releasably engaging said bristle-supporting portion of said body, said cleaning sheets being mounted for manual lift-off removal of individual sheets from said bristle-supporting portion for thereby removing hair or other foreign materials from said bristles; and an adhesive on at least one of the opposed faces of adjacent sheets of the pad to cause the sheets to remain in place until manually sequentially removed from the pad of sheets.

2. The brush of claim 1, each of said sheets presenting opposed upper and lower surfaces, the lower surfaces of the sheets having said adhesive applied thereto.

3. The brush of claim 1, each of said cleaning sheets having at least one line of perforation therein to facilitate removal of the sheet from the remainder of the sheets.

4. The brush of claim 1, each of said sheets of the pad including a tab portion extending away from said bristles for permitting manual grasping of a respective sheet for said lift-off removal thereof.

5. The brush of claim 1, said bristle-supporting portion comprising an elongated, substantially cylindrical portion, said bristles operatively coupled with said cylindrical portion and extending radially outwardly therefrom.

6. The brush of claim 1, said bristles comprising elongated wire elements.

7. The brush of claim 1, said bristles comprising elongated, flexible synthetic resin elements.

8. A self-cleaning brush comprising:

an elongated body including a handle portion and a bristle-supporting portion;

a plurality of spaced-apart bristles operatively coupled with said bristle-supporting portion and extending outwardly therefrom;

a plurality of individual, apertured, face-to-face oriented cleaning sheets receiving said bristles therethrough and positioned proximal to said bristle-supporting portion of said body, said cleaning sheets each being mounted for individual manual lift-off removal thereof for thereby removing hair or other foreign materials from said bristles; and a retainer operably engaging said sheets for retaining the same in place until said manual removal thereof.

9. The brush of claim 8, said retainer comprising wall structure for engaging said sheets.

10. The brush of claim 8, said retainer comprising a shiftable clip engaging portions of said sheets.

11. The brush of claim 8, each of said sheets presenting an outer and inner face, the inner faces of the sheets having adhesive applied thereto.

12. The brush of claim 8, said bristle-supporting portion being elongated and presenting a bristle-supporting face.

13. The brush of claim 8, said bristle-supporting portion being an elongated, generally cylindrical portion, said bristles operatively coupled to and extending radially from said cylindrical portion, said sheets extending around said cylindrical portion.

14. The brush of claim 8, each of said cleaning sheets having at least one line of perforation therein to facilitate removal of the sheet from the remainder of the sheets.

* * * * *